US007182227B2

(12) United States Patent
Poile et al.

(10) Patent No.: US 7,182,227 B2
(45) Date of Patent: Feb. 27, 2007

(54) AEROSOL DELIVERY SYSTEM

(75) Inventors: Steven Poile, Hull (GB); Geoffrey Robert Hammond, Hull (GB); Malcolm Tom McKechnie, Hull (GB)

(73) Assignee: Reckitt Benckiser (UK) Limited, Slough (GB)

( * ) Notice: Subject to any disclaimer, the term of this patent is extended or adjusted under 35 U.S.C. 154(b) by 292 days.

(21) Appl. No.: 10/475,911

(22) PCT Filed: Apr. 29, 2002

(86) PCT No.: PCT/GB02/01906

§ 371 (c)(1),
(2), (4) Date: Oct. 24, 2003

(87) PCT Pub. No.: WO02/087976

PCT Pub. Date: Nov. 7, 2002

(65) Prior Publication Data

US 2004/0149780 A1 Aug. 5, 2004

(30) Foreign Application Priority Data

Apr. 27, 2001 (GB) ..... 0110364

(51) Int. Cl.
*B67D 5/42* (2006.01)

(52) U.S. Cl. ..... 222/386; 141/20

(58) Field of Classification Search ..... 222/386, 222/389, 105–107; 604/892.1; 220/915; 141/3, 30

See application file for complete search history.

(56) References Cited

U.S. PATENT DOCUMENTS 3,128,922 A * 4/1964 Jacob ..... 222/389
3,189,231 A * 6/1965 Kibbel, Jr. et al. ..... 222/389
3,613,963 A * 10/1971 Berkmuller ..... 222/389
3,756,476 A * 9/1973 Bonduris ..... 222/386.5
3,819,092 A * 6/1974 Bonduris ..... 222/389
4,207,893 A 6/1980 Michaels ..... 128/260
4,350,271 A 9/1982 Eckenhoff ..... 222/386
5,065,900 A * 11/1991 Scheindel ..... 222/1
5,312,389 A * 5/1994 Theeuwes et al. ..... 604/892.1
5,346,476 A * 9/1994 Elson ..... 604/135
5,997,527 A * 12/1999 Gumucio et al. ..... 604/892.1

FOREIGN PATENT DOCUMENTS

WO WO 00/23663 4/2000

* cited by examiner

*Primary Examiner*—Lien M. Ngo
(74) *Attorney, Agent, or Firm*—Norris McLaughlin & Marcus, PA

(57) ABSTRACT

An aerosol delivery system comprises a container defining a chamber for a product to be delivered, an outlet from the chamber through which product may in operation be delivered, a valve for controlling passage of product through the outlet and a pump for pressurising product to be delivered, wherein the pump comprises an expandable material which, in operation, may be expanded to provide the pressure for pressurising product to be delivered, the expandable material being an osmotically effective agent and/or a swellable hydrogel and being disposed on one side of a semi-permeable membrane through which, in operation, fluid may be absorbed by the expandable material to expand it and thereby generate an osmotic pressure.

9 Claims, 3 Drawing Sheets

AEROSOL DELIVERY SYSTEM

Figure 1:
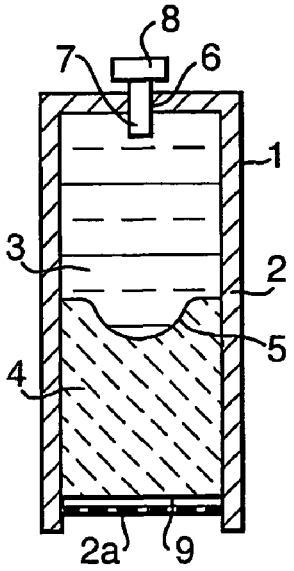

The present invention provides an aerosol delivery system driven by hydrostatic pressure from an osmotic or hydrogel swelling device.

The use of aerosol delivery systems for the delivery of active agents is well known for a broad range of applications from personal care to surface cleaning to air perfuming. Conventional aerosol delivery systems rely upon hydrostatic pressure being introduced to the device during manufacture to enable expulsion of the contents upon demand during use. Generally such hydrostatic pressure has been applied by the introduction of gaseous propellants under pressure during manufacture, for example air or butane. The disadvantage of such systems is that the internal pressure decreases as the system is used, reducing the delivery rate of the active agents. There can also be problems when inflammable propellants are used. Furthermore the manufacturing process is expensive because of the pressurised product. A solution to these problems has been sought.

According to the invention there is provided an aerosol delivery system comprising a container defining a chamber for a product to be delivered, an outlet from the chamber through which product may in operation be delivered, a valve for controlling passage of product through the outlet and a pump for pressurising product to be delivered, wherein the pump comprises an expandable material which, in operation, may be expanded to provide the pressure for pressurising product to be delivered, the expandable material being an osmotically effective agent and/or a swellable hydrogel, and being disposed on one side of a semi-permeable membrane through which, in operation, fluid may be absorbed by the expandable material to expand it and thereby generate an osmotic pressure.

The expandable material may apply pressure to the active agent via either an impermeable membrane or a piston.

Suitable materials for use as the swellable hydrogel include polymeric materials optionally blended homogeneously or heterogeneously with osmotically effective agents. The polymeric material is optionally of plant, animal or synthetic origin. The material interacts with water or a biological fluid by absorbing the water or fluid and swelling or expanding to an equilibrium state. The polymeric material preferably exhibits the ability to retain a significant fraction of imbibed fluid in its polymeric molecular structure.

Preferably the polymeric material is a gel polymer that can swell or expand to a very high degree; for example it can have a 2- to 50-fold volume increase. A suitable gel polymer is a swellable, hydrophilic polymer (or an osmopolymer) which is optionally either non-cross-linked or lightly cross-linked. The cross-links can be covalent, ionic or hydrogen bonds so that the polymer possesses the ability to swell in the presence of fluid but does not dissolve in the fluid.

A polymeric material suitable for use in the expandable member is, for example, a poly(hydroxyalkylmethacrylate) having a molecular weight of from 5,000 to 5,000,000; poly(vinyl pyrrolidone) having a molecular weight of from 10,000 to 360,000; an anionic and/or cationic hydrogel; a poly(electrolyte) complex; poly(vinyl alcohol) having a low acetate residual; a swellable mixture of agar and carboxymethyl cellulose; a swellable composition comprising methyl cellulose mixed with a sparingly cross-linked agar; a water-swellable copolymer produced by a dispersion of finely divided copolymer of maleic anhydride with styrene, ethylene, propylene or isobutylene; a water-swellable polymer of N-vinyl lactams; or a swellable sodium salt of carboxymethyl cellulose.

Alternatively, the polymeric material could be a gelable, fluid-imbibing and -retaining polymer such as a pectin having a molecular weight ranging from 30,000 to 300,000; a polysaccharide such as agar, acacia, karaya, tragacenth, algins and guar; an acidic carboxy polymer or its salt derivative such as one sold under the trade name Carbopol; a polyacrylamide; a water-swellable indene maleic anhydride polymer; a polyacrylic acid having a molecular weight of 80,000 to 200,000 such as one sold under the trade name Good-rite; a polyethylene oxide polymer having a molecular weight of 100,000 to 5,000,000 such as one sold under the trade name Good-rite; a starch graft copolymer; an acrylate polymer with water absorbability of about 400 times its original weight such as one sold under the trade name Aqua-Keep; a diester of polyglucan; a mixture of cross-linked poly(vinyl alcohol) and poly (N-vinyl 2 pyrrolidone); or poly(ethylene glycol) having a molecular weight of 4,000 to 100,000.

Other suitable polymer materials for use as the expandable member are those disclosed in U.S. Pat. Nos. 3,865,108, 4,002,173, 4,207,893, 4,220,152, 4,327,725 and 4,350, 271, all of which are incorporated herein by reference, and in Scott et al, Handbook of Common Polymers, CRC Press, Cleveland, Ohio (1971).

The osmotically effective agent is in general an osmotically effective solute which is soluble in fluid imbibed into the expandable member such that there is an osmotic pressure gradient across the semi-permeable membrane against the fluid source. A suitable osmotically effective agent is, for example, magnesium sulphate, magnesium chloride, sodium chloride, lithium chloride, potassium chloride, potassium sulphate, sodium sulphate, sodium phosphate (including hydrates thereof), mannitol, urea, sorbitol, inositol, sucrose, dextrose, lactose, fructose, glucose, magnesium succinate, sodium carbonate, sodium sulphite, sodium bicarbonate, potassium acid phthalate, calcium bicarbonate, potassium acid phosphate, raffinose, tartaric acid, succinic acid, calcium lactate or mixtures thereof. The osmotic pressure in atmospheres (atm) of the osmotically effective agents suitable for use in the invention must be greater than zero atm, generally from 8 atm up to 500 atm, or higher.

The solution of the osmotically effective agent exhibits an osmotic pressure gradient against the fluid source, and is preferably a saturated aqueous salt solution. To maintain the solution saturated and therefore to achieve a constant osmotic pressure throughout operation of the dispenser, the expandable member containing the solution also contains an excess of the osmotically effective agent in solid form. The amount of the excess osmotically effective agent depends on the size of the system and the amount of product to be delivered. The excess solid can be in the form of dispersed particles or, preferably, in the form of a pellet. The solution can initially be a solution of the same or of an osmotically effective agent different from the solid excess agent.

The semi-permeable membrane is permeable to water but impermeable to the osmotically effective compound. Examples of suitable semi-permeable membranes include semi-permeable homopolymers or copolymers. For example, the semi-permeable membrane is based on a cellulose ester, cellulose monoester, cellulose diester, cellulose triester, cellulose ether, cellulose ester ether; mono-, di- and tri-cellulose alkanylate; mono-, di- and tri alkenylate; and/or mono-, di- and tri-aroylate. Suitable examples of cellulose esters include cellulose acylate, cellulose diacylate, cellulose triacylate, cellulose acetate, cellulose diacetate and cellulose triacetate.

The cellulose polymers suitable for use as the semi-permeable membrane have a degree of substitution (D.S.) on their anhydroglucose unit from greater than zero to three. The "degree of substitution" is the average number of hydroxyl groups originally present on the anhydroglucose unit which have been replaced by a substituting group or converted into another group.

The anhydroglucose unit can be partially or completely substituted with groups such as acyl, alkanoyl, aroyl, alkyl, alkenyl, alkoxyl, halogen, carboalkyl, alkylcarbamate, alkylcarbonate, alkylsulfonate, and other semi-permeable polymer forming groups which would be known to a person of skill in the art.

A suitable polymer for use as the semi-permeable membrane includes a cellulose acetate having a D.S. of 1.8 to 2.3 and an acetyl content of 32% to 39.9%; cellulose diacetate having a D.S. of 1 to 2 and an acetyl content of 21% to 35%; and/or cellulose triacecate having a D.S. of 2 to 3 and an acetyl contact of 34% to 44.8%. More specifically, suitable cellulosic polymers include cellulose propionate having a D.S. of 1.8 and a propionyl content of 38.5%; cellulose acetate propionate having an acetyl content of 1.5% to 7% and a propionyl content of 39% to 42%; cellulose acetate propionate having an acetyl content of 2.5% to 3%, an average propionyl content of 39.2% to 45% and a hydroxyl content of 2.8% to 5.4%; cellulose acetate butyrate having a D. S. of 1.8, an acetyl content of 13% to 15% and a butyryl content of 34% to 39%; cellulose acetate butyrate having an acetyl content of 2% to 29.5%, a butyryl content of 17% to 53% and a hydroxyl content of 0.5% to 4.7%; cellulose triacylates having a D.S. of 2.9 to 3, such as cellulose trivalerate, cellulose trilaurate, cellulose tripalmitate, cellulose trioctanoate, and cellulose tripropionate; cellulose diesters having a D.S. of 2.2 to 2.6, such as cellulose disuccinate, cellulose dipalmitate, cellulose dioctanoate and cellulose dicarpylate; cellulose propionate morpholinbutyrate; cellulose acetate butyrate; cellulose acetate phthalate; mixed cellulose esters, such as cellulose acetate validate, cellulose acetate succinate, cellulose propionate succinate, cellulose acetate octanoate, cellulose valerate palmitate, cellulose acetate heptonate, and the like. Suitable semi-permeable polymers are disclosed in U.S. Pat. No. 4,077,407, which is incorporated herein by reference, and they can be made by procedures described in Encyclopedia of Polymer Science and Technology Vol. 3. pages 325–354, Interscience Publishers Inc., New York (1964).

Other suitable semi-permeable polymers include cellulose acetaldehyde, dimethyl cellulose acetate; cellulose acetate ethylcarbomate; cellulose acetate methylcarbomate; cellulose dimethylaminoacetate, a cellulose composition comprising cellulose acetate and hydroxypropylmethylcellulose; a composition comprising cellulose acetate and cellulose acetate butyrate; a cellulose composition comprising cellulose acetate butyrate and hydroxypropylmethylcellulose; semi-permeable polyamides; semi-permeable polyurethanes; semi-permeable polysulfanes; semi-permeable sulfonated polystyrene; crosslinked selectively semi-permeable polymers formed by the coprecipitation of a polyanion and a polycation as disclosed in U.S. Pat. Nos. 3,173,876, 3,276,586, 3,541,005, 3,541,006 and 3,546,142, all of which are incorporated herein by reference; selectively semi-permeable silicon rubbers; semi-permeable polymers as disclosed by Loeb and Sourirajan in U.S. Pat. No. 3,133,132, incorporated herein by reference, semi-permeable polystyrene derivatives; semi-permeable poly sodiumsytrenesulfonate); semi-permeable poly(vinylbenzyltrimethyl) ammonium chloride semi-permeable polymers exhibiting a fluid permeability of from $10^{-1}$ to $10^{-7}$ (cc.mil/cm$^2$ hr-atm) expressed as per atmosphere of hydrostatic or osmotic pressure difference across a semi-permeable wall. The polymers are known to the art in U.S. Pat. Nos. 3,845,770, 3,916,899 and 4,160,020, all of which are incorporated herein by reference; and in J. R. Scott and W. J. Roff, *Handbook of Common Polymers*, CRC Press, Cleveland, Ohio, (1971).

The semi-permeable membrane is preferably supported in such a way that it is substantially inflexible such that its shape and position do not change as the expandable material expands. This is in order that the pressure generated in the system by the expandable material is not applied to the fluid source but instead to the product to be delivered.

Preferably, the aerosol delivery system includes a flexible impermeable membrane disposed between the pump and product to be delivered. For example, the flexible impermeable membrane might form a partition dividing the container into sub-chambers. As an alternative to a flexible impermeable membrane, the pump and product to be delivered may be separated by a piston.

In general, the impermeable membrane must be impermeable to water and the osmotically effective agent. Suitable impermeable materials include polyethylene, compressed polyethylene fine powder, polyethylene terephthalate (such as that marketed under the name Mylar), plasticized polyvinyl chloride, metal-foil polyethylene laminates, neoprene rubber, natural gum rubber and rubber hydrochloride such as that marketed under the name Pliofilm. These materials are preferably flexible, insoluble and chemically compatible with the product to be delivered. Additional suitable materials include polystyrene, polypropylene, polyvinyl chloride, reinforced epoxy resin, polymethylmethacrylate, or styrene/acrylonitrile copolymer.

The valve used in the aerosol delivery system according to the invention is optionally either manually operable or automatic. Where the valve is automatic, the pressure at which it operates is preferably variable. In general, a suitable automatic aerosol valve is a pressure actuated valve capable of releasing the compressed contents of a reservoir in stages as the contents of the reservoir reach a pre-determined internal pressure. A suitable activation pressure for the valve is from 2 to 10 atmospheres, preferably from 5 to 10 atmospheres, for example 7 atmospheres. With a low activation pressure of, for example, 2, 3 or 4 atmospheres a product can be delivered as a fine spray or stream. The shut off pressure for the automatic valve may be, for example, a pressure which is from 0.1 to 1 atmosphere less than the activation pressure or a pressure which is about 90% of the activation pressure.

Where the aerosol delivery system according to the invention is provided with a semi-permeable membrane, the membrane is preferably covered by a rupturable impermeable membrane. This is in order that the initial activation of the system can be controlled by the user. Optionally, the system is provided with means for rupturing the rupturable impermeable membrane, for example by making part of the container rotatable relative to the remainder.

A suitable container for use in the present invention is any conventionally used container which is able to withstand being pressurised. Suitable materials for making the container include metal or plastic materials, for example aluminium, tin plate, polyethylene terephthalate (PET), polyethylene naphalate (PEN) or a PET/PEN mixture, or glass particularly with a plastics safety layer.

A suitable product to be delivered by the system of the invention is, for example, a pesticide, herbicide, germicide, biocide, algicide, rodenticide, fungicide, insecticide, insect repellent, anti-oxidant, sterilant, plant growth promoter or inhibitor, preservative, anti-preservative, disinfectant, surface cleaning agent, enzyme digestant, air freshener, deodorant, antiperspirant, depilatory, antiseptic, polish, wax, odour neutraliser, laundry care agent, hair lacquer, topical skin treatment, catalyst, chemical reactant fermentation agent, food, food supplement, nutrient, cosmetic, drug, vitamin, sex sterilant, fertility inhibitor or promoter, air purifier, and/or microorganism attenuator. A suitable drug is any physiologically or pharmacologically active substance that produces a localised or systemic effect in a non-human animal, human, avian and/or domestic, recreational or farm animal. The drug may be administrable by topical, oral, nasal, opthalmic, rectal and/or vaginal means.

The fluid source is either provided from an external source or is within the container. The fluid source is preferably water.

The aerosol delivery system according to the invention can be activated either during manufacture or by the user when ready to use. For the system to be activated, the semi-permeable membrane of the expandable member needs to come into contact with a fluid source. The system may be activated: a) during manufacture, by the introduction of the external fluid to the pump device prior to aerosol device closure; or b) prior to first use by user, by introduction of an external fluid source; or removal of an internal seal.

The aerosol delivery system according to the invention can be activated to release the active agent either manually or by automatic action. The flow of the fluid from the fluid source to the pump may be controlled by modification of the semi-permeable membrane so that the time during which the system becomes repressurised following activation can be lengthened, if desired.

A further advantage of the invention is that it provides an aerosol delivery system which can be reactivated by the user.

Figure 2:
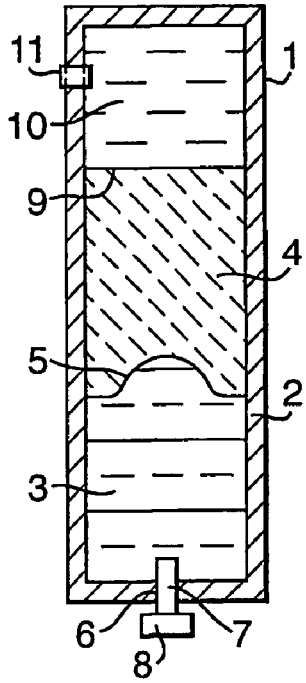
Figure 3:
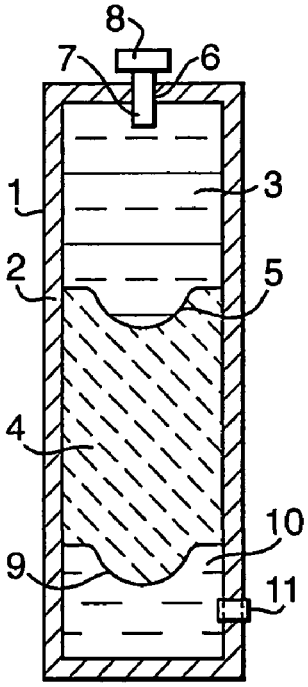
Figure 4A:
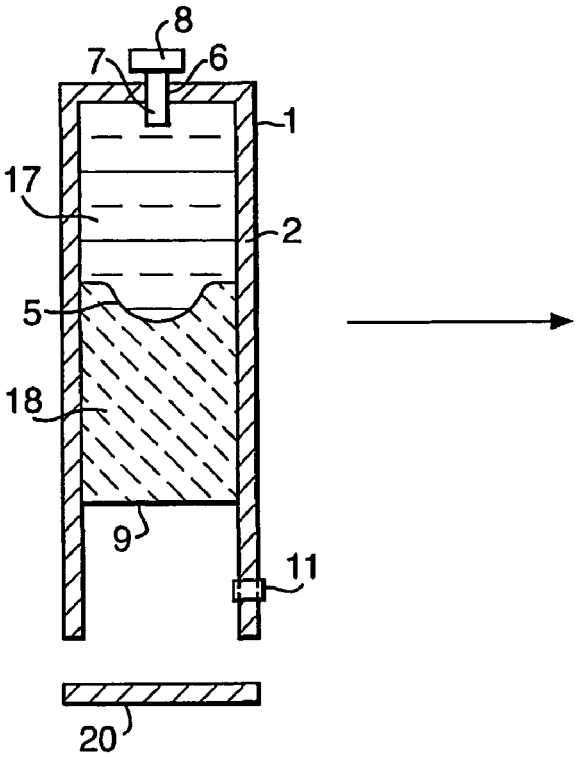
Figure 4B:
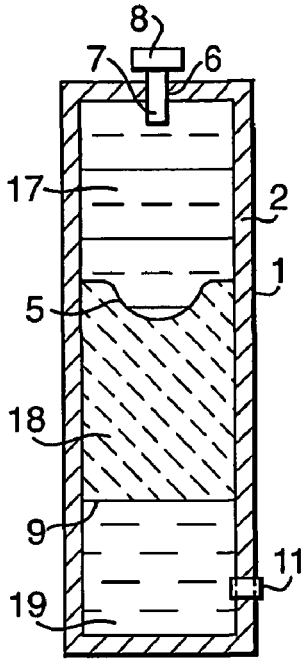
Figure 5A:
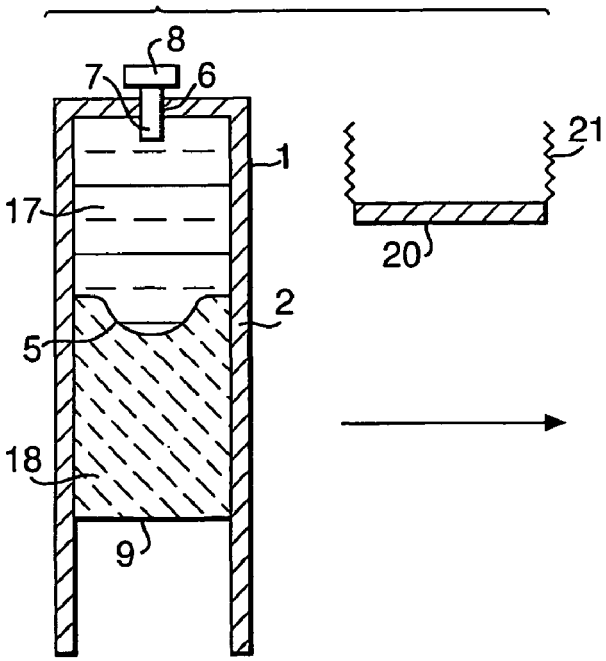
Figure 5B:
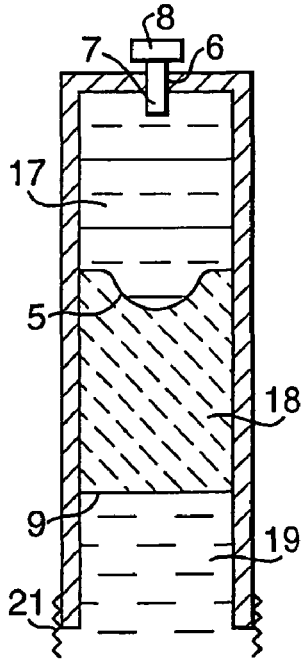
Figure 6A:
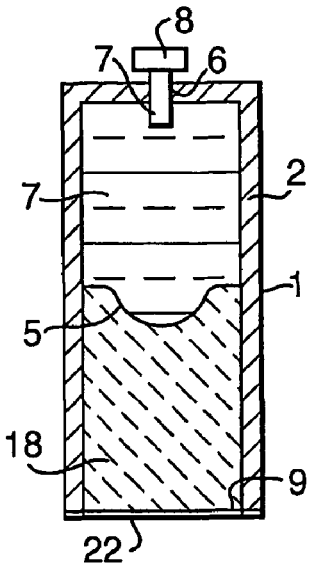
Figure 6B:
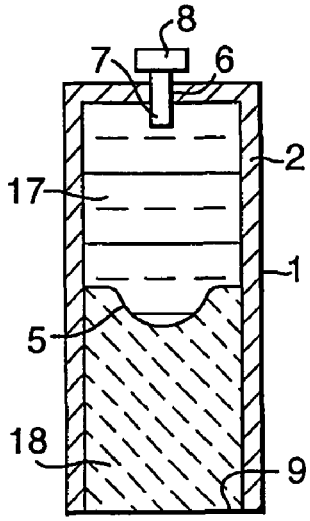
Figure 7A:
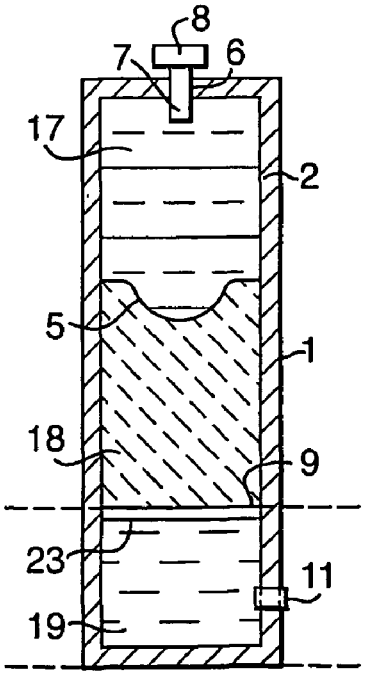
Figure 7B:
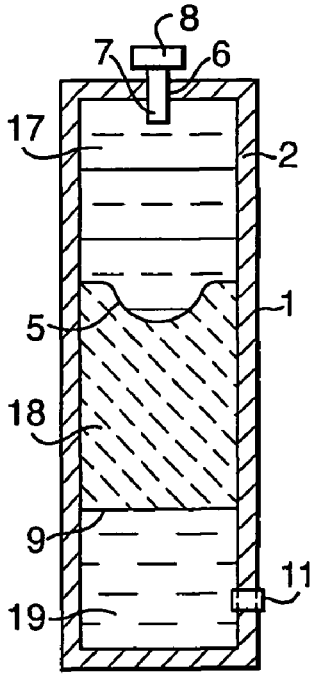

For a better understanding of the invention and to show how the same may be carried into effect, reference will now be made, by way of example, to the accompanying drawings in which:

FIG. 1 diagrammatically shows in section an aerosol according to the present invention, FIG. 2 diagrammatically shows in section a modified form of the aerosol shown in FIG. 1, FIG. 3 diagrammatically shows in section a further modified form of the aerosol shown in FIG. 1, FIGS. 4*a* and 4*b* show stages in the manufacture of the embodiment of FIG. 2, FIGS. 5*a* and 5*b* show stages in the manufacture of a modified form of the aerosol shown in FIG. 2, FIGS. 6*a* and 6*b* show stages in the manufacture of the embodiment of FIG. 1, and FIGS. 7*a* and 7*b* show stages in the manufacture of a further modified form of the embodiment of FIG. 2.

Referring to FIG. 1, a first embodiment of the invention comprises a container 1 having a substantially non-deformable water-insoluble wall 2 defining a chamber divided into two sub-chambers 3 and 4 by means of a flexible impermeable membrane 5. The wall 2 defines an outlet 6 leading from sub-chamber 3. An aerosol valve 7 is disposed in the outlet 6 and is operable by means of a button 8. Product to be delivered is disposed in sub-chamber 3 and an expandable material is disposed in sub-chamber 4. Sub-chamber 4 is closed off at its end remote from the aerosol valve 7 by means of a semi-permeable membrane 9. The semi-permeable membrane is preferably supported in such a way that it is substantially inflexible so that its shape and position do not change as the expandable material expands. For example, a rigid support matrix 2*a* could support a non-rigid membrane 9. In operation, fluid from an external source (not shown) permeates through the semi-permeable membrane 9 by osmosis and/or other hydration forces and is absorbed by the expandable material disposed in sub-chamber 4. This results in a pressure increase which is transmitted through the flexible impermeable membrane 5 to the product to be delivered in sub-chamber 3. This pressure may be released by depressing button 8 which opens the valve 7 enabling the product to be delivered to issue through the outlet 6 as a spray or a stream, for example a gel, cream or mousse. As an alternative to manual activation of the valve 7, activation may be automatic. In this alternative, the valve 7 may open automatically when a predetermined threshold pressure is reached. The valve may remain open or may close automatically. Automatic closure may occur when the pressure falls below a certain predetermined pressure or after a certain predetermined time. Where the valve remains open, the delivery is a one shot delivery and when the valve is closed, a repetitive or pulsed delivery which depends for its cycle time on the time required for the pump to recharge to an acceptable threshold pressure, as explained above. A one shot delivery may be required for sanitary purposes and a repetitive pulsed system for a room air freshener where a new release of product to be delivered would generally be required at predetermined intervals. In, ne aforementioned sanitory application, the external source of fluid may be provided by the water in a cistern, whereas, in the repetitive pulsed system, the aerosol may be stood in a bowl of water to provide fluid from an external source.

In FIGS. 2, 3, 4*a*, 4*b*, 5*a*, 5*b*, 6*a*, 6*b*, 7*a* and 7*b* corresponding parts to parts of FIG. 1 are denoted by like reference numerals.

Referring to FIG. 2, a second embodiment of the invention is the same as the embodiment of FIG. 1 except that the fluid is incorporated as an integral part of the aerosol, instead of being provided from an external source. Thus, this second embodiment comprises a container 1 having a substantially non-deformable water-insoluble wall 2 defining a chamber which is divided into three sub-chambers 3, 4 and 10. Sub-chamber 3 contains the product to be delivered and is separated from sub-chamber 4 by means of a flexible impermeable membrane 5. Sub-chamber 4 contains an expandable material and is separated from sub-chamber 10 by means of a substantially inflexible semi-permeable membrane 9. Sub-chamber 10 contains fluid and is provided with a non-return valve 11. A hydrophobic porous sinter, for example, in the form of a disc, could be used as an alternative to a non-return valve. The purpose of the non-return valve or the hydrophobic porous sinter is to allow passage of air into sub-chamber 10 without allowing the fluid in the chamber to escape. This is necessary to equalise the pressure in the chamber during operation of the aerosol. In this embodiment, the aerosol must be inverted to ensure that the fluid maintains contact with the semi-permeable membrane 9 following the passage of air into sub-chamber 10. As an alternative to a valve or a porous sinter, the portion of the wall 2 which defines sub-chamber 10 could be made collapsible. As with the embodiment of FIG. 1, the wall 2 defines an outlet 6 in which a valve 7, which may be operated by means of a button 8, is disposed. Operation is similar to that of the embodiment of FIG. 1, the only difference being that the fluid permeates from the internal source 10 through semi-permeable membrane 9 to raise the pressure in sub-chamber 4. Again the manually operable valve may be made automatic in the same way and for the same purpose as the automatic valve alternative described with reference to FIG. 1.

Referring to FIG. 3, a third embodiment of the invention is the same as the embodiment of FIG. 2 except that the aerosol is not inverted. Instead, the geometry of the semi-permeable membrane 9 is adapted to allow the fluid to remain in contact with the membrane following the passage of air into sub-chamber 10. Many different arrangements can be envisaged which would allow the fluid to maintain contact with the membrane. For example, the membrane could comprise a series of tubular fibres. Alternatively, a wick, for example of cellulose wadding, could be attached to the underside of the semi-permeable membrane 9 to allow the fluid to remain in contact with the membrane, in which case the membrane 9 could be planar.

FIGS. 4*a* and 4*b* illustrate a mode of manufacture for the embodiment of FIG. 2. The product to be delivered 17, impermeable membrane 5, expandable material 18, flexible semi-permeable membrane 9 and fluid 19, are introduced into the container 1 in turn, following which, a base 20, which is initially separate, is added and sealed in position to produce the finished product. The container 1 has a substantially non-deformable water-insoluble wall 2 which defines an outlet 6 in which an aerosol valve 7 operable by means of a button 8 is disposed. The container 1 is also provided with a non-return valve 11. For the reasons explained above, this aerosol must either be inverted, or the geometry of the membrane must be adapted, or a wick used, to allow the fluid to remain in contact with the semi-permeable membrane.

FIGS. 5*a* and 5*b* show a mode of manufacture similar to that of FIGS. 4*a* and 4*b* but where base 20 is connected, for example by a screw thread, to the remainder of container 1 by means of a collapsible bellows portion 21. This enables the fluid to be pressurised externally by the consumer after manufacture and sale. In particular, the use of collapsible bellows obviates the need for a non-return valve 11. In all other respects manufacture is as in the embodiment of FIGS. 4*a* and 4*b*.

FIGS. 6*a* and 6*b* show a mode of manufacture for the embodiment of FIG. 1. In this embodiment, fluid to activate the osmotic agent and/or swellable hydrogel is not provided at the manufacturing stage, but is supplied by the customer, for example, in the manner already described. Advantageously, after introducing the product to be delivered 17, impermeable membrane 5, and expandable material 18, the container is closed off at its base by the semi-permeable membrane 9. However, to avoid unwanted absorption through this membrane 9 after manufacture but before delivery to the customer, the membrane needs protection. This is provided by an impermeable adhesive strip 22 which may be removed by the customer prior to placing the semi-permeable membrane 9 in contact with an external source of fluid.

FIGS. 7*a* and 7*b* illustrate another mode of manufacture of a variation of the embodiment of FIG. 2. In this embodiment, the fluid to be absorbed into the osmotic agent and/or swellable hydrogel is introduced into the container during manufacture. To increase the shelf life of the system, means may be provided to enable the customer to activate the product after purchase. For this purpose, the semi-permeable membrane 9 is protected by a rupturable impermeable membrane 23, which prevents fluid permeating through the semi-permeable membrane 9 before the system reaches the customer. In order to rupture the impermeable membrane 23, the lower part of the container 1 is made rotatable relative to the remainder of the container, and the customer twists this part to rupture membrane 23 to allow the fluid to permeate the semi-permeable membrane 9 to activate the aerosol as previously described. Again, this aerosol must either be inverted, or the geometry of the membrane must be adapted, or a wick used, to allow the fluid to remain in contact with the semi-permeable membrane.

The above embodiments have been described by way of example only and many variations are possible without departing from the scope of the invention.

The invention claimed is:

1. An aerosol delivery system comprising a container defining a chamber for a product to be delivered, an outlet from the chamber through which product may in operation be delivered, a valve for controlling passage of product through the outlet and a pump for pressurising product to be delivered, wherein the pump comprises an expandable material which, in operation, may be expanded to provide the pressure for pressurising product to be delivered, the expandable material being an osmotically effective agent or a swellable hydrogel and being disposed on one side of a semi-permeable membrane which is covered by a rupturable impermeable membrane through which, in operation, fluid may be absorbed by the expandable material to expand it and thereby generate an osmotic pressure.

2. An aerosol delivery system as claimed in claim 1, in which means are provided for rupturing the rupturable impermeable membrane.

3. An aerosol delivery system as claimed in claim 2, in which part of the container is made rotatable relative to the remainder to provide means for rupturing.

4. An aerosol delivery system according to claim 1 wherein a flexible impermeable membrane is disposed between the pump and product to be delivered.

5. An aerosol delivery system according to claim 4, in which the flexible impermeable membrane forms a partition dividing the container into sub-chambers.

6. An aerosol delivery system according to claim 1 in which the valve is manually operable.

7. An aerosol delivery system according to claim 1 in which the valve is automatic.

8. An aerosol delivery system according to claim 7, in which the pressure at which the valve operates is variable.

9. A method of manufacturing an aerosol delivery system according to claim 1 comprising the steps of:

(a) introducing the product to be delivered, the impermeable membrane, the expandable material, the semi permeable membrane and the fluid to the container; and (b) adding a base, which is initially separate to the container and sealing said base into position.

* * * * *

UNITED STATES PATENT AND TRADEMARK OFFICE

CERTIFICATE OF CORRECTION

PATENT NO. : 7,182,227 B2
APPLICATION NO. : 10/475911
DATED : February 27, 2007
INVENTOR(S) : Poile et al.

It is certified that error appears in the above-identified patent and that said Letters Patent is hereby corrected as shown below:

Assignee (73), "Reckitt Bencklser (UK) Limited" should read -- Reckitt Benckiser (UK) Limited --

Signed and Sealed this

Twenty-fifth Day of November, 2008

JON W. DUDAS
*Director of the United States Patent and Trademark Office*